US009206574B2

(12) United States Patent
Parker

(10) Patent No.: US 9,206,574 B2
(45) Date of Patent: Dec. 8, 2015

(54) AGGREGATE REPLACEMENT

(71) Applicant: Alton F. Parker, Clifton Park, NY (US)

(72) Inventor: Alton F. Parker, Clifton Park, NY (US)

( * ) Notice: Subject to any disclaimer, the term of this patent is extended or adjusted under 35 U.S.C. 154(b) by 0 days.

(21) Appl. No.: 14/282,801

(22) Filed: May 20, 2014

(65) Prior Publication Data

US 2014/0294508 A1 Oct. 2, 2014

Related U.S. Application Data

(63) Continuation-in-part of application No. 13/851,004, filed on Mar. 26, 2013, now Pat. No. 9,139,971.

(51) Int. Cl.
*E02B 11/00* (2006.01)
*E03F 1/00* (2006.01)

(52) U.S. Cl.
CPC ..... *E02B 11/005* (2013.01); *E03F 1/002* (2013.01)

(58) Field of Classification Search
CPC ..... E02B 11/00; E02B 11/005; E03F 1/005
USPC ..... 405/43, 45, 50
See application file for complete search history.

(56) References Cited

U.S. PATENT DOCUMENTS

| | | | | |
|---|---|---|---|---|
| 4,183,484 | A | 1/1980 | Mathews | |
| 4,192,628 | A | 3/1980 | Gorman | |
| 4,588,325 | A | 5/1986 | Seefert | |
| 4,909,665 | A | 3/1990 | Caouette | |
| 4,982,533 | A * | 1/1991 | Florence | 405/51 |
| 4,983,069 | A * | 1/1991 | Florence | 405/43 |
| 5,051,028 | A | 9/1991 | Houck et al. | |
| 5,437,424 | A | 8/1995 | Netz, Sr. | |
| 5,553,975 | A | 9/1996 | Elkins | |
| 5,605,419 | A | 2/1997 | Reinert, Sr. | |
| 5,639,364 | A | 6/1997 | Houck et al. | |
| 5,810,509 | A | 9/1998 | Nahlik, Jr. | |
| 5,810,510 | A * | 9/1998 | Urriola | 405/45 |
| 6,095,718 | A | 8/2000 | Bohnhoff | |
| 6,428,870 | B1 | 8/2002 | Bohnhoff | |
| 6,602,023 | B2 * | 8/2003 | Crescenzi et al. | 405/42 |
| 6,648,549 | B1 | 11/2003 | Urriola | |
| 6,779,946 | B1 | 8/2004 | Urriola et al. | |
| 7,191,802 | B2 | 3/2007 | Koerner | |
| 7,207,747 | B1 | 4/2007 | England | |
| 7,413,381 | B1 * | 8/2008 | Bracone, Jr. | 405/45 |

(Continued)

OTHER PUBLICATIONS

French drain, Wikipedia, last edited on Mar. 18, 2014: http://en.wikipedia.org/wiki/French_drain.

(Continued)

*Primary Examiner* — Frederick L Lagman
(74) *Attorney, Agent, or Firm* — Schmeiser, Olsen & Watts LLP

(57) ABSTRACT

An aggregate replacement device may be used to take replace rock aggregate in underground drainage systems. An aggregate replacement device may include a structure having a proximal end, a distal end, and at least one face. The at least one face may have a plurality of first openings. A second opening in the structure may extend from the proximal end to the distal end of the structure continuing uninterrupted through at least one of the at least one faces. The second opening may receive a pipe inserted in a radial direction of the pipe. The aggregate replacement device may also include a pipe retainer. An additional embodiment of the aggregate replacement device may include a stake which may be used to secure the aggregate replacement device in position.

17 Claims, 14 Drawing Sheets

(56) References Cited

U.S. PATENT DOCUMENTS

| | | | | |
|---|---|---|---|---|
| 7,517,172 | B2 * | 4/2009 | Sipaila | 405/45 |
| 7,591,610 | B2 | 9/2009 | Krichten et al. | |
| 7,621,695 | B2 | 11/2009 | Smith et al. | |
| 7,677,835 | B2 | 3/2010 | Oscar | |
| 7,712,997 | B2 | 5/2010 | Roelfsema | |
| 7,909,535 | B2 | 3/2011 | Samara | |
| 7,942,371 | B1 | 5/2011 | McCoy | |
| 2009/0080976 | A1 * | 3/2009 | Anderlind et al. | 405/45 |
| 2009/0279953 | A1 | 11/2009 | Allard et al. | |
| 2010/0021236 | A1 | 1/2010 | Kreikemeier | |
| 2010/0189514 | A1 | 7/2010 | Gunn et al. | |
| 2011/0204529 | A1 | 8/2011 | Kerkhoff et al. | |

OTHER PUBLICATIONS

Polypipe Polystorm Soakaway Crate, Drainageonline.co.uk, Accessed on May 19, 2014: http://www.drainageonline.co.uk/Soakaway-%26-Geotextiles/Polystorm-Soakaway-Crate.htm.

Soakaways, www.DrainageSales.com, Accessed on May 19, 2014: http://www.drainagepipe.co.uk/products/soakaways-155/.

Rainwater Harvesting Underground Water Tank (Re-use Tank), www.atlantiscorp.com.au, Accessed on May 19, 2014: http://www.atlantiscorp.com.au/solutions/landscaping/rainwater-harvesting.

Atlantis 30mm Flo-Cell® The Orginal Drainage Cell, www.drainagecell.com, Accessed on May 19, 2014: http://www.drainagecell.com/30mmflocell.html.

EZ Flow French Drain, www.ndspro.com, Accessed on May 20, 2014: http://www.ndspro.com/image-library/french-drains/ezflow-french-drain-gallery.

French Drains, www.MapleValleyTractorServices.com, Accessed on May 20, 2014: http://www.maplevalleytractorservices.com/id64.html.

French Drains, Ditches, and Swales; www.maggiesfarm.anotherdotcom.com, Accessed on May 20, 2014: http://maggiesfarm.anotherdotcom.com/archives/13979-French-Drains,-Ditches,-and-Swales.html.

All About French Drains, www.lisklandscape.com, Accessed on May 20, 2014: http://www.lisklandscape.com/landscaping-ideas/how-to-install-a-french-drain/.

Classic Drainage, Inc.; www.classicdrainage.com, Accessed on May 20, 2014: http://classicdrainage.com/.

Homeowner's Newsletter, www.homeinspectionnewsletter.blogspot.com, Accessed on May 20, 2014: http://homeinspection-newsletter.blogspot.com/2009/06/water-problems-and-solutions-under-your.html.

How to dig and install a French Drain to collect and move rain water away from your home, www.easydigging.com, Accessed on May 20, 2014: http://www.easydigging.com/Drainage/installation_french_drain.html.

Form-a-Drain, www.nitterhousemasonry.com, Accessed on May 20, 2014: http://www.nitterhousemasonry.com/products/form-a-drain/.

Polypipe Building Products, www.polypipe.com, Accessed on May 20, 2014: http://www.polypipe.com/building-products/.

* cited by examiner

AGGREGATE REPLACEMENT

CROSS-REFERENCE TO RELATED APPLICATION

This application is a continuation-in-part of pending U.S. patent application Ser. No. 13/851,004 to Alton Parker entitled "AGGREGATE REPLACEMENT", filed Mar. 26, 2013, which application is incorporated herein by reference.

BACKGROUND OF THE INVENTION

1. Technical Field

This invention relates to French drains and in particular to a device which can be used to replace the aggregate used in French drains or other water distribution systems.

2. Background Art

French drains are widely used in residential and commercial building applications to collect groundwater and distribute it away from the proximity of basements, foundations, footings, and similar surface and subterranean building structures where water may penetrate and/or damage these structures. An additional use of this technology is to deliver water into the sub-surface of the ground. For example, a French drain may be used to distribute fluid into the drain field of a residential septic system.

Various structures have been developed over the last two hundred years to accomplish this diversion of fluids. Generally, they consist of a pipe containing multiple small perforations throughout its sidewall through which water or fluid enters the pipe. The fluid then travels down the pipe to a desired location. To keep the perforations in the pipe from clogging, and to prevent dirt or other material from the surrounding substrate from entering the pipe, the pipe is laid within a bed of solid granular material that creates a porous aggregate unrestrictive to the flow of fluid, such as gravel, or a similar synthetic aggregate. Finally, a woven, coarse, landscape textile or filter fabric is used to surround and cover the aggregate to prevent the aggregate from becoming clogged with dirt or other surrounding substrate. The pipe, surrounding aggregate, and textile are typically installed within a trench which is then filled to grade level with dirt or other substrate. Rainwater or other surface water in the area seeps from the surrounding substrate through the textile where it may trickle freely through the aggregate into the pipe for removal from the area.

One significant problem with this system is the labor and expense necessary to surround the pipe with the aggregate. Also, if the aggregate is too heavy or is not placed carefully on top of the pipe, the pipe may break or collapse while the aggregate is being placed. This can cause time consuming and expensive problems.

Various inventions have been made in order to try and prevent these problems. For example, U.S. Pat. No. 5,810,509 issued to Nahlik, Jr. discloses a cell system for buried drainage pipes. These cells, however, cannot be used to form continuous French drains. Instead, there are individual cells that are spaced throughout the drainage area. These cells also do not protect the areas of pipe between the cells and therefore there may be a problem with these areas of pipe being damaged when the trench they are laid in is filled.

U.S. Pat. No. 7,191,802 issued to Koerner (hereinafter "Koerner") and U.S. Pat. No. 5,051,028 issued to Houck et al. (hereinafter "Houck"), also attempt to improve French drains by replacing the standard aggregate. They, however, do not allow the aggregate replacement and pipe to be easily assembled on site.

Instead Houck discloses units that are manufactured as one piece with sections of perforated pipe inside. Multiple units are hooked together. Therefore if a section of pipe becomes damaged, the entire unit must be replaced rather than just the pipe.

Koerner discloses a system where netting filled with aggregate is wrapped along a perforated pipe. This system takes too long to conveniently assemble on site and therefore will likely need to be preassembled. Therefore if the pipe gets damaged the entire assembly will need to be replaced rather than simply replacing the pipe.

Also, while these patents claim to protect the pipe, in reality they would provide very little protection to the pipe when the trench is being filled in with substrate.

Accordingly, what is needed is an aggregate replacement device that is light weight, easy to use, quick to install and which allows the pipe to be accessed and inserted after the aggregate replacement has been placed in the trench.

DISCLOSURE OF THE INVENTION

The aggregate replacement device, as disclosed hereafter in this application, is strong, lightweight and easy to assemble.

In particular embodiments, an aggregate replacement device includes a structure with a proximal end, a distal end, and at least one face wherein the at least one face includes a plurality of first openings. A second opening in the structure extends from the proximal end to the distal end continuing uninterrupted through at least one of the at least one faces. The second opening is configured to receive at least one pipe inserted in a radial direction of the at least one pipe.

Additional embodiments of an aggregate replacement device may include a structure having a proximal end, a distal end, and at least one face that is water permeable. The aggregate replacement device may also include an opening in the at least one outer face that extends from the proximal end to the distal end of the structure continuously. The opening may be configured to receive at least one pipe inserted in a radial direction of the at least one pipe. The opening may further include at least one pipe retainer.

Other embodiments of an aggregate replacement device may include a structure having a proximal end, a distal end, and at least two faces. The at least two faces further contain a plurality of first openings. A stake may be coupled to the structure to secure the structure in a desired position. A concrete barrier may be placed abutting at least one of the at least two faces. An second opening in the structure may extend from the proximal end of the structure to the distal end of the structure continuing uninterrupted through at least one of the at least two faces. The second opening, however, continues through a different at least one of the at least two faces than the concrete barrier abuts. The second opening may be configured to receive at least one pipe inserted in a radial direction of the at least one pipe.

Further embodiments of an aggregate replacement device may include a structure having a proximal end, a distal end, and at least one face. The at least one face has a plurality of first openings. A second opening may be located in the proximal end. A third opening may also be located in the structure. A first end of a pipe is in communication with the second opening and the pipe extends through the structure. A second end of the pipe is in communication with the third opening.

Embodiments of an aggregate replacement device may also include a structure having a proximal end, a distal end, and at least one face. The at least one face may have a plurality of first openings. The proximal end may also comprise at least one cutout, wherein the at least one cutout intersects an edge of the proximal end.

Yet more embodiments of an aggregate replacement device may include at least one face, wherein the at least one face has a plurality of openings. At least one coupler may be coupled to the at least one face. At least one distal end and at least one proximal end may be hingedly coupled to at least one the at least one face.

The foregoing and other features and advantages of the aggregate replacement device will be apparent to those of ordinary skill in the art from the following more particular description of the invention and the accompanying drawings.

BRIEF DESCRIPTION OF THE DRAWINGS

The invention will hereinafter be described in conjunction with the appended drawings where like designations denote like elements, and.

DESCRIPTION OF THE INVENTION

Figure 1:
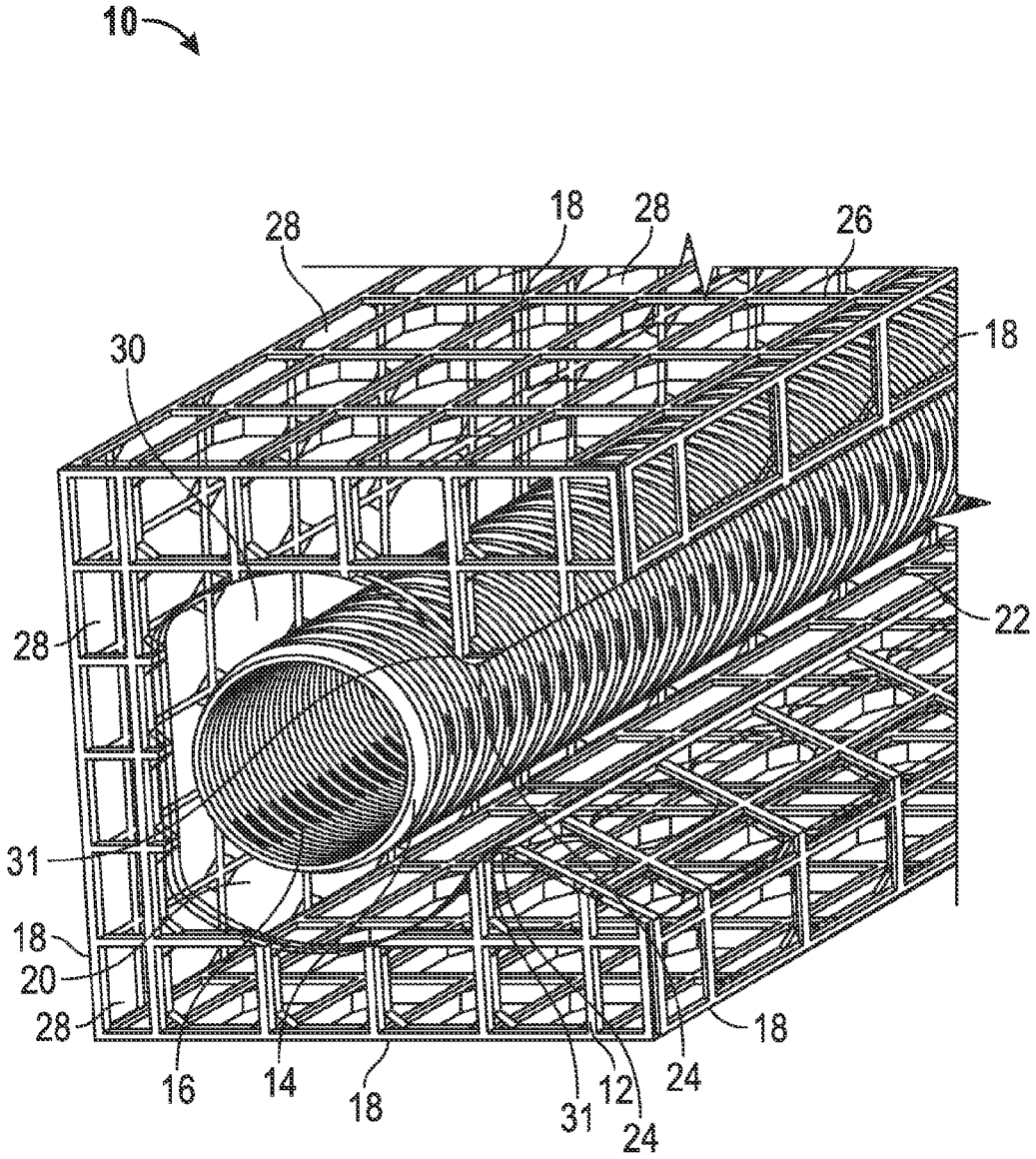
FIG. 1 is an isometric view of an aggregate replacement configured according to a first embodiment.

As discussed above, embodiments of the present invention relate to an aggregate replacement device for use in French drains and the like. In particular, disclosed is an aggregate replacement device including a structure with fluid permeable surfaces, and an opening configured to receive a pipe inserted parallel to a diameter of the pipe.

When French drains or other drainage or fluid distribution systems are set up, a trench is dug in the ground in the area where the water is to be drained from. The trench is then lined with a landscape, filter fabric or other water permeable material which prevents the soil or substrate from the surrounding area from entering the trench. Aggregate may then be placed in the bottom of the trench. This aggregate is typically washed gravel or a synthetic aggregate that allows water to flow freely through. A perforated pipe is then placed on top of the aggregate. The perforated pipe could also be placed directly on the filter fabric in the bottom of the trench. The perforated pipe is then covered with additional aggregate. The top of the additional aggregate may have more filter fabric placed on it. Then top soil and plants may be placed on the filter fabric hiding the French drain underground.

FIGS. 1-6 illustrate an aggregate replacement 10 configured according to embodiments of the present invention. The aggregate replacement 10 takes the place of the washed gravel or synthetic aggregate in a French drain or other water distribution system.

The aggregate replacement 10 includes a structure 26 which is formed as an open scaffolding. The structure 26 includes a proximal end 12, a distal end 32 and at least one face 18. The proximal end 12 is coupled to the at least one face 18. In the figures, the proximal end 12 is coupled at a 90 degree angle to four faces 18. The four faces 18 illustrated are rectangular or square. It is anticipated, however, that only one face 18 could be used. This face 18 would be curved in order to form a cylindrical aggregate replacement. It is also anticipated that three faces 18 could be utilized in order to form a structure with a triangular cross section. A plurality of faces 18 greater than four could also be used to form the structure 26. The number of faces 18 and the desired shape of the structure 26 will determine the angle at which the faces are coupled to the proximal end 12. The four faces 18, shown in the figures, are also coupled to each other at 90 degree angles. The angle at which the faces 18 are coupled to each other will vary depending on the number and shape of faces 18 utilized. The distal end 32 is coupled to the remaining open edges of the four faces 18. The arrangement described and depicted in the figures results in a cube or rectangular prism shaped structure 26. However, the structure 26 may be any type of shape desired. The at least one face 18, proximal end 12, and distal end 32 may also be formed in any shape desired.

In additional embodiments, the structure 26 may be curved in order to form circular, serpentine or other irregularly shaped drains.

The structure 26 forms a mostly hollow interior 20. The mostly hollow interior 20 may contain supports or other devices necessary to strengthen the structure 26. However, these devices should not impede the flow of water in the interior 20 of the structure 26. The mostly hollow interior 20 of the structure 26 allows water to drain through the structure 26 just like water would drain through the washed gravel or synthetic aggregate of traditional drains.

Figure 2:
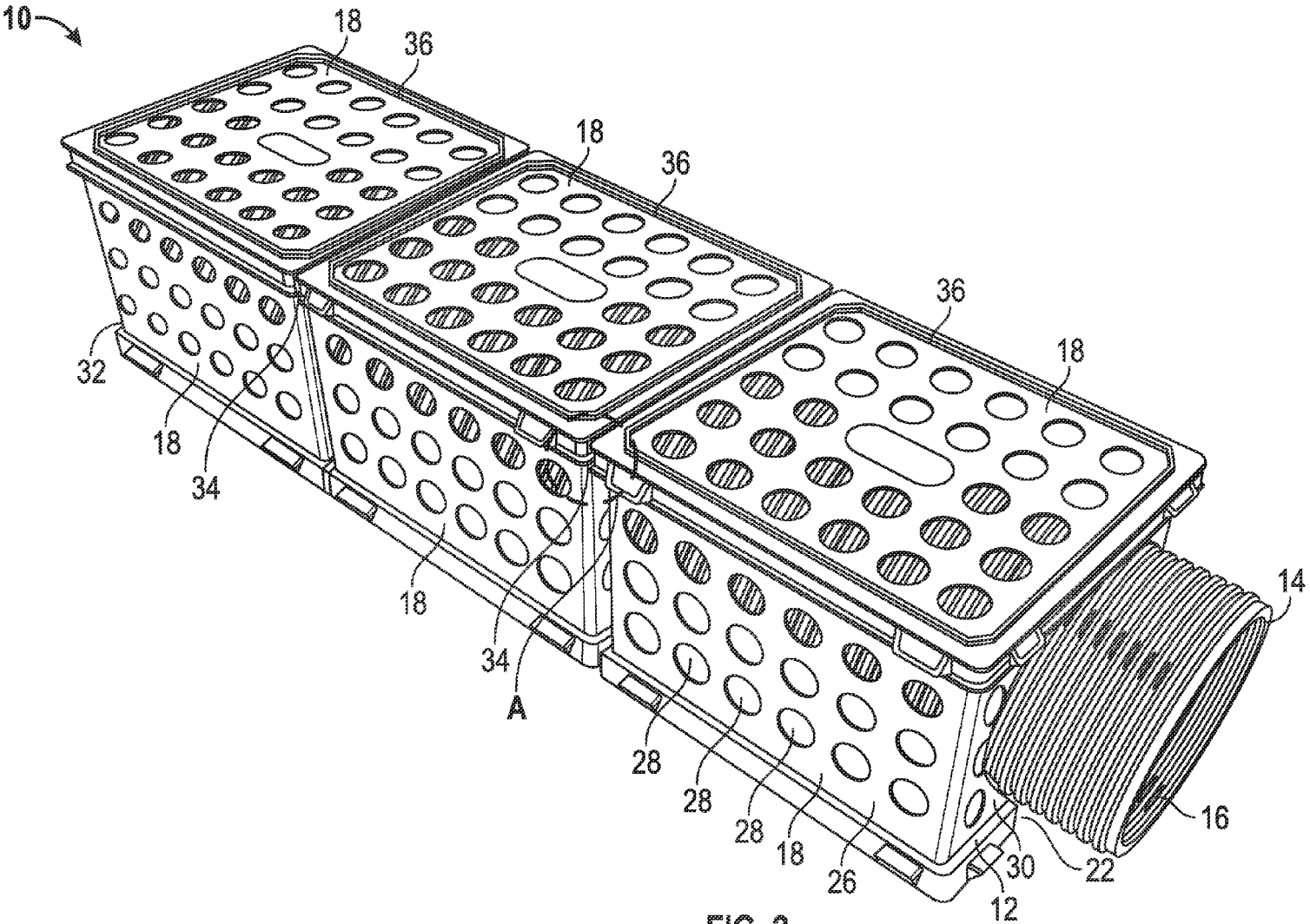
FIG. 2 is an isometric view of an aggregate replacement configured according to a second embodiment.
Figure 3:
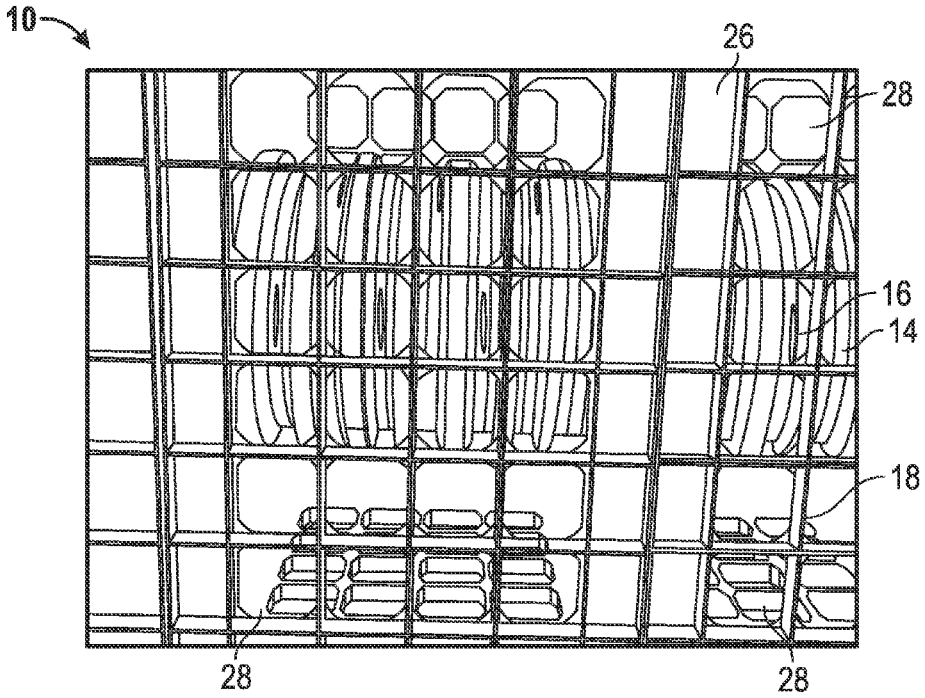
FIG. 3 is a first side view of an aggregate replacement configured according to the embodiments of FIG. 1.
Figure 4:
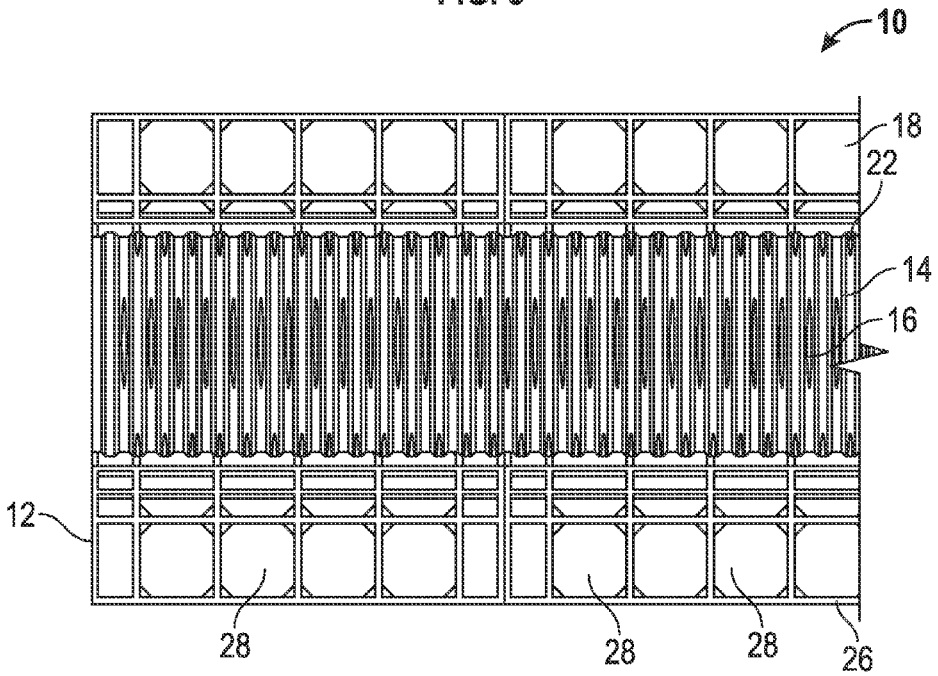
FIG. 4 is a second side view of an aggregate replacement configured according to the embodiments of FIG. 1.

The proximal end 12, distal end 32 and at least one face 18 are water permeable. This is accomplished by forming at least one first opening 28 in the proximal end 12, distal end 32 and at least one face 18. In FIG. 1, the proximal end 12, distal end 32 and four faces 18 are all formed with multiple square openings 28 separated by thin structural members which help structure 26 maintain its shape while allowing fluid, typically water, to pass easily through the proximal end 12, distal end 32 and faces 18. FIG. 2 has multiple round openings 28 in the proximal end 12, distal end 32 and at least one face 18. The at least one first opening 28 may be any size or shape desired so long as the openings 28 are a size and shape that allow water to easily permeate the surfaces of the structure 26 and enter the mostly hollow interior 20.

It alternate embodiments, the proximal end 12, the distal end 32 of the structure 26 and at least one but not all of the faces 18 may not contain any openings 28.

Figure 11:
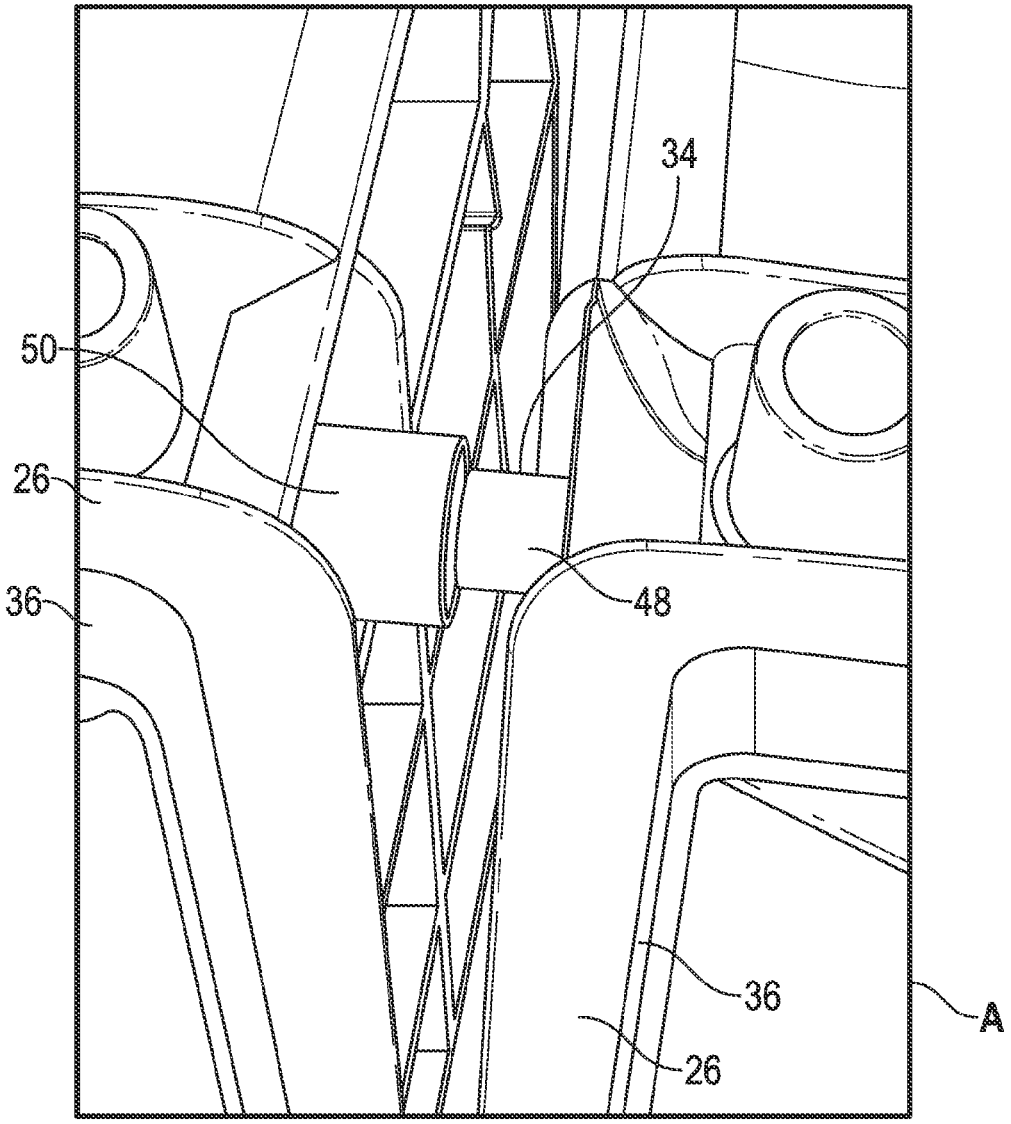
FIG. 11 is a close up view of an area denoted by A in FIG. 2.

The aggregate replacement 10 may be formed as one single piece that runs the entire length of the drain or it may be formed in smaller pieces that are connected together. FIG. 2 illustrates an embodiment of an aggregate replacement 10 which is composed of multiple units 36 which are coupled together with connectors 34. These connectors 34 may be any type of connector that holds two aggregate replacement units 36 together. FIG. 11 is a close up of section A from FIG. 2. FIG. 11 shows a connector 34. In this illustration, the connector is a pin 48 which slides into a receiver 50. The pin 48 is simply a cylindrical extension from the structure 26 of the aggregate replacement 10. The receiver 50 is an open cylindrical extension of the structure 26 of the aggregate replacement 10. The pin and the receiver are close enough in size that by inserting the pin 48 into the receiver 50, the units 36 are kept reasonably securely connected.

In alternate embodiments, the connector 34 may be flexible in order to allow the units 36 to be connected in a circular, serpentine, or non-linear arrangement.

In other embodiments, multiple units 36 may simply be placed adjacent each other without the use of connectors. The pipe 14 would then be inserted into the units 36. The units 36 would be held adjacent to each other by the pipe 14.

FIGS. 1-6 also show a second opening in a face 18 of the structure 26. The second opening may comprise an insertion opening 22, a pipe retainer and a pipe receiver 30. The insertion opening 22 is created in one of the at least one faces 18 of the structure 26. The insertion opening 22 allows a pipe 14 with perforations 16 to be inserted in a radial direction into the aggregate replacement 10. The insertion opening 22 should be large enough to allow a pipe 14 of a desired size to be inserted into the structure 26 of the aggregate replacement 10. The insertion opening 22 runs the entire length of one of the at least one faces 18 as shown FIG. 4 which is a side view of the aggregate replacement 10.

Figure 5:
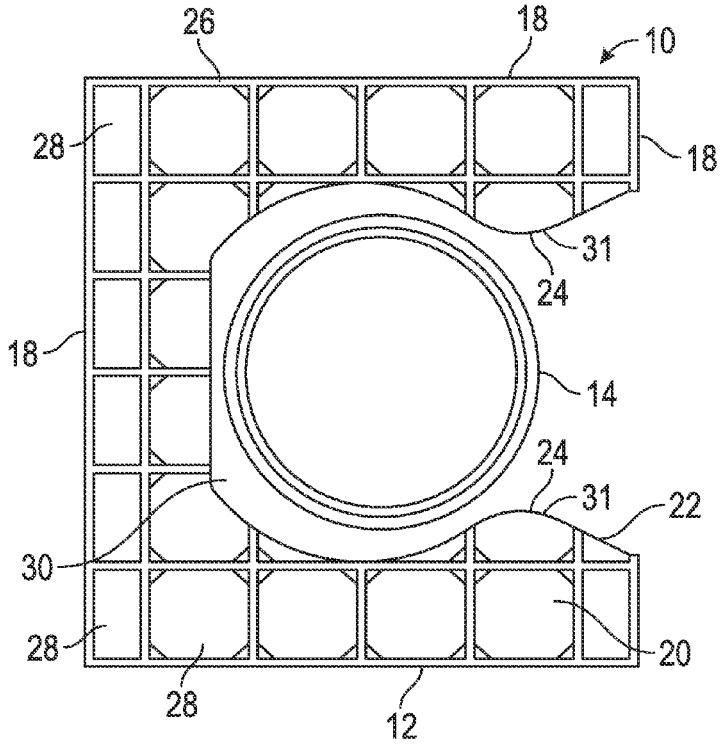
FIG. 5 is an end view of an aggregate replacement configured according to the embodiments of FIG. 1.

FIG. 5 is a view of the proximal 12 or distal end 32 of the structure 26. The insertion opening 22 also extends through the proximal end 12 and the distal end 32 of the structure 26. In the proximal end 12 and the distal end 32 of the structure, the insertion opening 22 forms a pipe receiver 30.

The pipe receiver 30 is an opening formed in the proximal end 12 and the distal end 32 of the structure 26. The pipe receiver 30 is slightly larger than the diameter of the pipe 14 and holds the pipe 14 when the drain is in place. The pipe receiver 30 has a mouth which connects to the insertion opening 22.

At the mouth 31 of the pipe receiver 30, may be a pipe retainer. The pipe retainer may comprise at least one protrusion 24. The at least one protrusion 24 narrows the insertion opening 22 to less than the diameter of the pipe 14. The at least one protrusion 24 may be flexible, or the pipe 14 may be slightly flexible in order to allow the pipe 14 to be forced past the at least one protrusion 24 and through the mouth 31 of the pipe receiver 30. The at least one protrusion 24 will then hold the pipe 14 within the pipe receiver 30.

Figure 8:
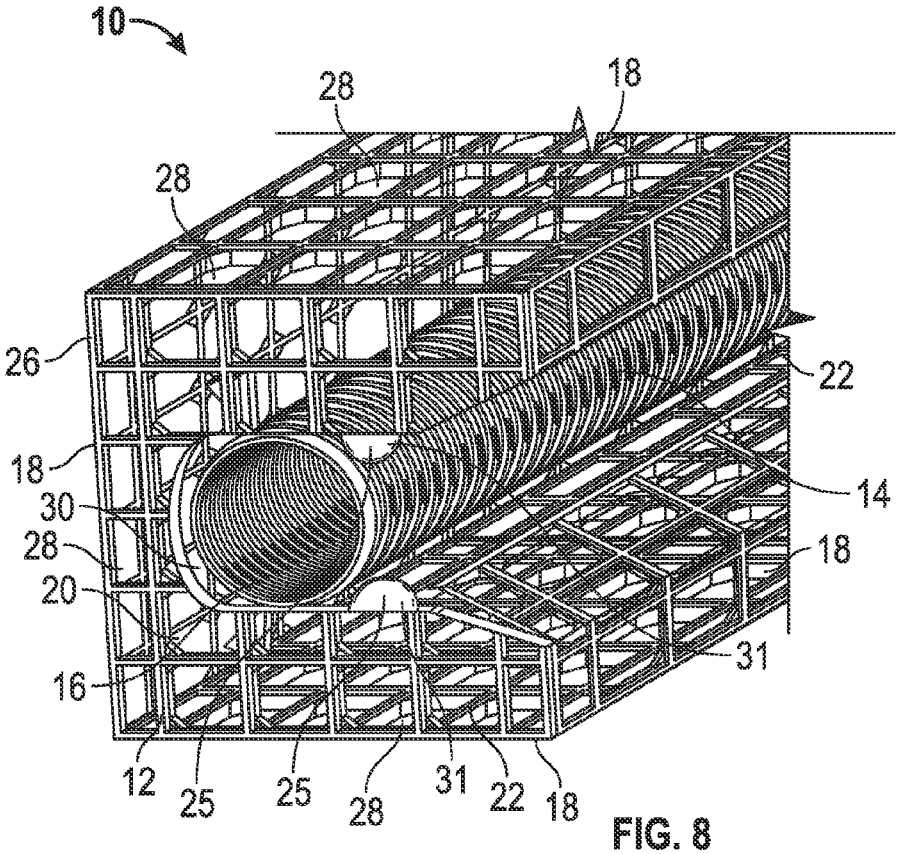
FIG. 8 is an isometric view of an aggregate replacement configured according to a fifth embodiment.

The pipe retainer may also be simply a narrowing of the insertion opening 22 or in an alternate embodiment of the invention as shown in FIG. 8, the pipe retainer may be tabs 25 manufactured at the mouth of a U shaped pipe receiver 30. The tabs 25 along with the U shaped pipe receiver 30 act to hold the pipe 14 in place within the aggregate replacement 10.

Figure 7:
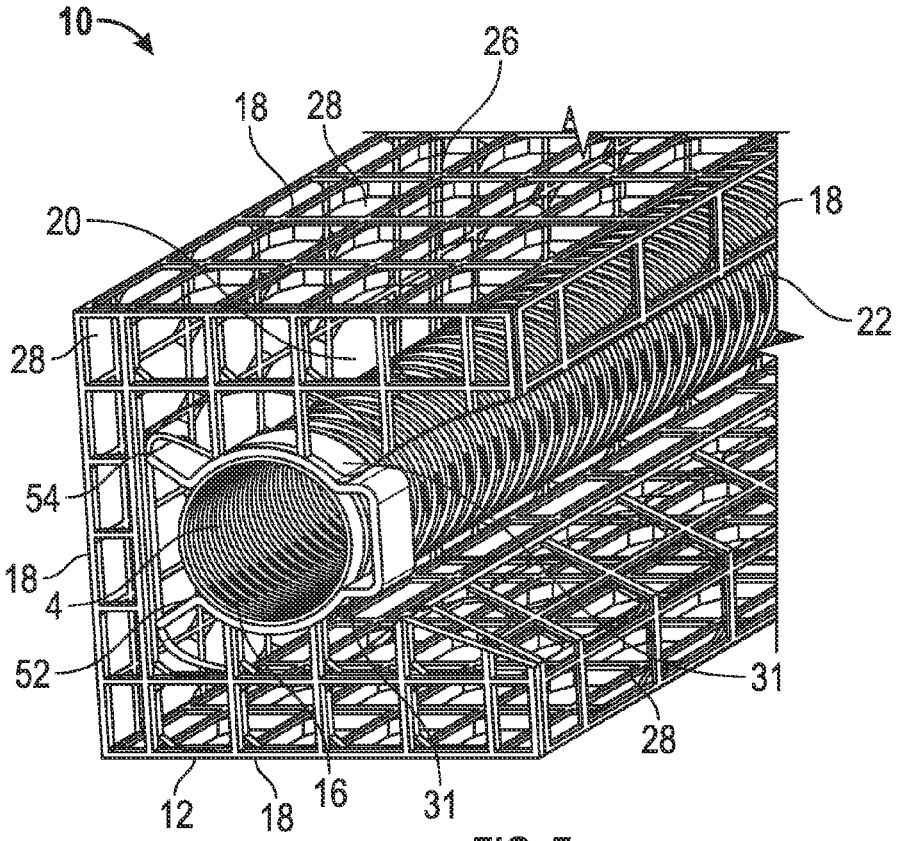
FIG. 7 is an isometric view of an aggregate replacement configured according to a fourth embodiment.

FIG. 7 illustrates an additional embodiment of the aggregate replacement 10, where the pipe retainer uses a pipe clip 52 placed on the pipe 14, prior to the pipe 14 being placed in the insertion opening 22. The pipe clip 52 is then snapped into a pipe clip retainer 54 which is formed into the edge of the pipe receiver 30. The pipe 14 is then held firmly in place in the pipe receiver 30.

Figure 9:
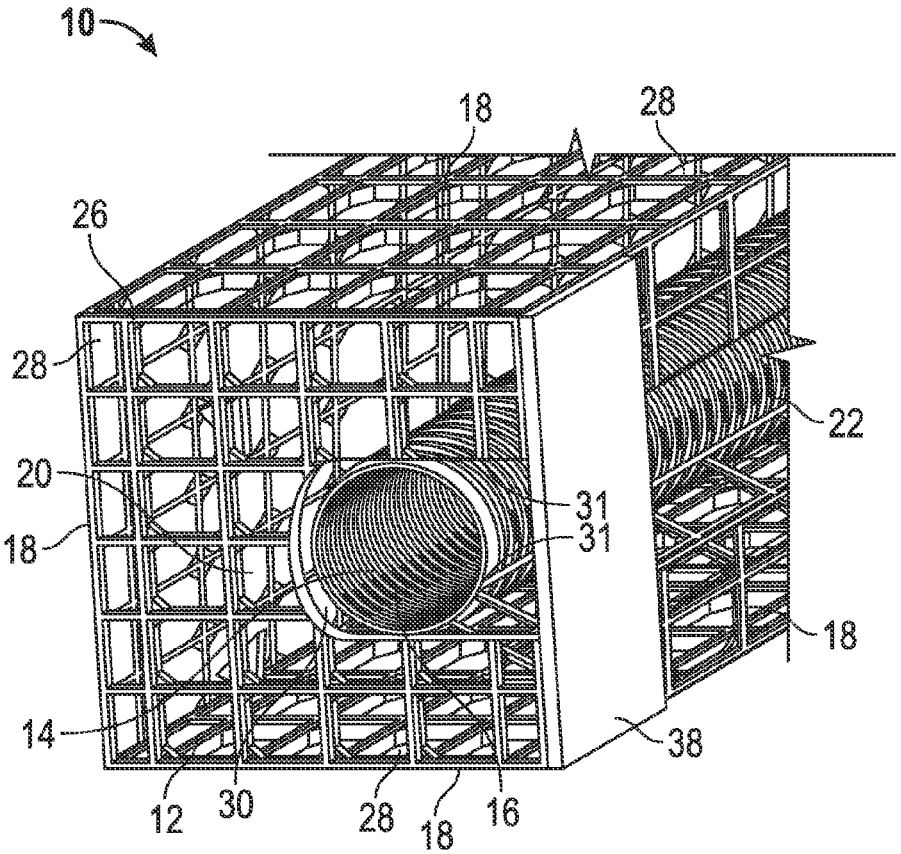
FIG. 9 is an isometric view of an aggregate replacement configured according to a sixth embodiment.

FIG. 9 illustrates yet another embodiment of the pipe retainer. In this embodiment, the pipe 14 is held in the pipe receiver 30 by a strap 38 which is coupled to the structure 26 of the aggregate replacement 10.

Figure 10:
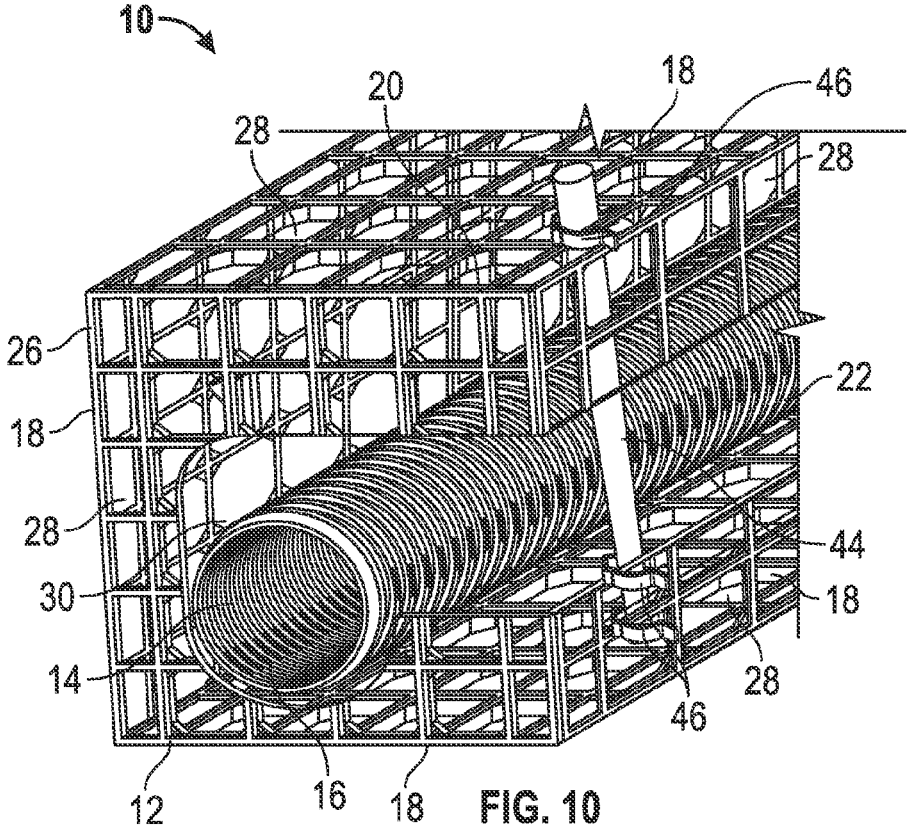
FIG. 10 is an isometric view of an aggregate replacement configured according to a seventh embodiment.

In FIG. 10, the pipe 14 is retained in place in the pipe receiver 30 by gravity. The insertion opening 22 is located slightly above the center of the pipe receiver 30. The pipe 14 passes through the insertion opening 22 and drops into the pipe receiver 30. The pipe 14 then stays in place because it is lower than the insertion opening 22.

FIG. 10 also shows a pipe retainer using a stake 44 which is placed in a stake retainer 46. The stake 44 is simply a metal or wooden stake or rigid rod that is placed inside of an opening called a stake retainer 46. The stake 44 is then usually driven into the ground under the aggregate replacement 10. The stake 44 serves two purposes. First, the stake 44 holds the aggregate replacement 10 in place. Second, the stake 44 prevents the pipe 14 from leaving the pipe receiver 30.

The stake retainer 46 may be a hole in the structure which is designed to have the stake 44 placed in it, as shown in FIG. 10. The stake retainer 46 may also be a strap which straps the stake 44 to the outside of the structure 26. The stake retainer 46 may further be a bolt or screw which bolts or screws the stake 44 to the structure 26. The stake retainer 46 may be any device which couples the stake 44 to the structure 26. Coupling the stake 44 to the structure 26 may include receiving the stake 44 in an opening, physically attaching the stake 44 to the structure 26 or the like.

Figure 6:
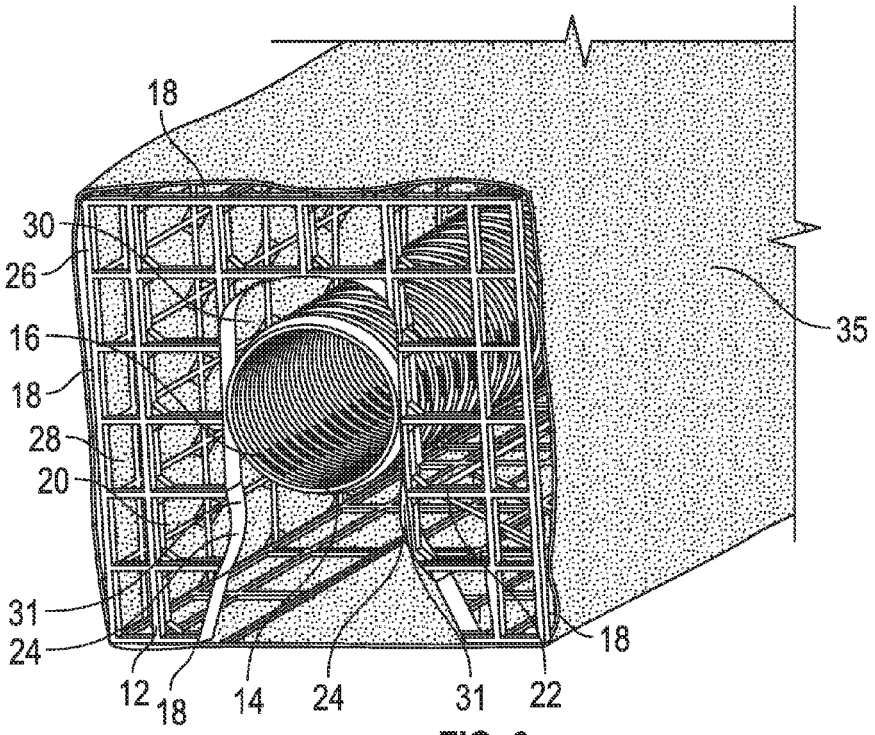
FIG. 6 is an isometric view of an aggregate replacement covered by a liner configured according to a third embodiment.

Once the pipe 14 is inserted into the aggregate replacement 10, the aggregate replacement 10 is either placed in a trench lined with filter fabric or the aggregate replacement 10 is wrapped in filter fabric. FIG. 6 illustrates the aggregate replacement 10 wrapped in filter or landscape fabric 35. The filter or landscape fabric 35 is the same type of fabric used in traditional arrangements of a French drain. The fabric 35 is a water permeable material that prevents soil, rocks, substrates or other things that might clog the perforations 16 in the pipe 14 from entering the aggregate replacement 10.

In using the aggregate replacement 10 embodiments described above, a trench is dug where the drain or distribution system is to be placed. The trench is lined with a water permeable fabric 35 such as landscape fabric, filter fabric, water permeable material or the like. The aggregate replacement 10 is then assembled. If there is more than one unit 36, then the units 36 may be connected together through use of the connectors 34. The pipe 14 is then inserted through the insertion opening 22. The pipe 14 is forced past the protrusions 24 or tabs 25 if protrusions 24 or tabs 25 are being used. The pipe 14 passes through the mouth of the pipe receiver 31 and into the pipe receiver 30. If protrusions 24 or tabs 25 are not being used, then the pipe retainer is now engaged. The aggregate replacement 10 along with the pipe 14 already inserted is then laid on top of the fabric 35 in the trench. Typically, the aggregate replacement 10 will be placed in the trench with the insertion opening 22 positioned towards the bottom of the trench as shown in FIG. 6. This position places the pipe 14 towards the bottom of the trench where more water can flow through the perforations 16 into the pipe 14.

The fabric 35 is then wrapped around the aggregate replacement 10 and the trench is filled in.

In alternate embodiments the aggregate replacement 10 may be wrapped in the fabric 35 prior to being placed in the trench.

The pipe 14 could also be inserted into the aggregate replacement 10 after the aggregate replacement 10 is in place in the trench.

When in use, water flows through the fabric 35 and through the openings 28 in the faces 18 of the aggregate replacement 10 structure 26. The water then flows through the perforations 16 into the pipe 14. The pipe 14 will typically be angled so that the water flows down the pipe 14 and to a desired location.

This process works in reverse for other water distribution systems such as those used in residential septic systems.

Figure 12:
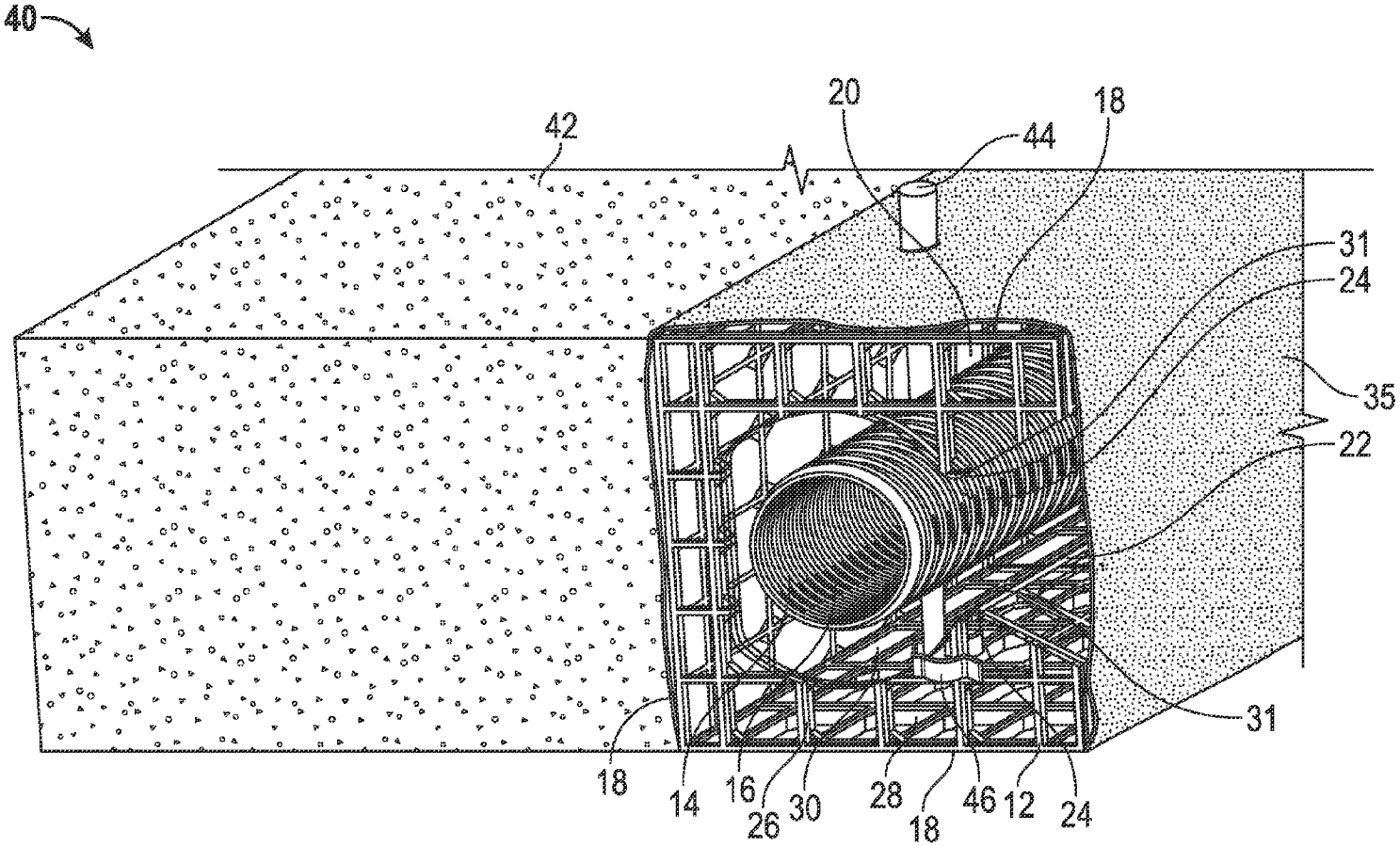
FIG. 12 is an isometric view of an aggregate replacement concrete form configured according to an embodiment.

An additional embodiment of the aggregate replacement is illustrated in FIG. 12. In this embodiment, the aggregate replacement 40 is formed as described above. A stake retainer 46 may also be formed in the structure 26 on the side of the pipe receiver 30 away from the insertion opening 22. The stake 44 in this case will be used only to hold the aggregate replacement 40 in place. In alternate embodiments, a stake retainer 46 may be anything that couples the stake 44 to the structure 26. The aggregate replacement 40 is put in position with the face 18 of the structure 26 opposite the insertion opening 22 acting as a concrete form. The face 18 of the structure 26 opposite the insertion opening 22 is covered with a concrete barrier 35 such as filter fabric, landscape fabric, screen, water permeable material, solid plastic or the like. The concrete barrier 35 may or may not be water permeable. The concrete barrier 35 may be any material that retains the concrete in place while it is curing.

Concrete 42 may then be poured, with the concrete 42 coming up against the water permeable barrier 35. Once the concrete 42 has dried, the pipe 14 may be placed in the aggregate replacement 40 if it has not already been placed.

This arrangement allows moisture to be drained away from the concrete 42. The moisture travels through the material 35, passes through the aggregate replacement 40 and enters the pipe 14 through the perforations 16. The moisture then travels down the pipe 14 and away from the concrete 42.

Figure 13:
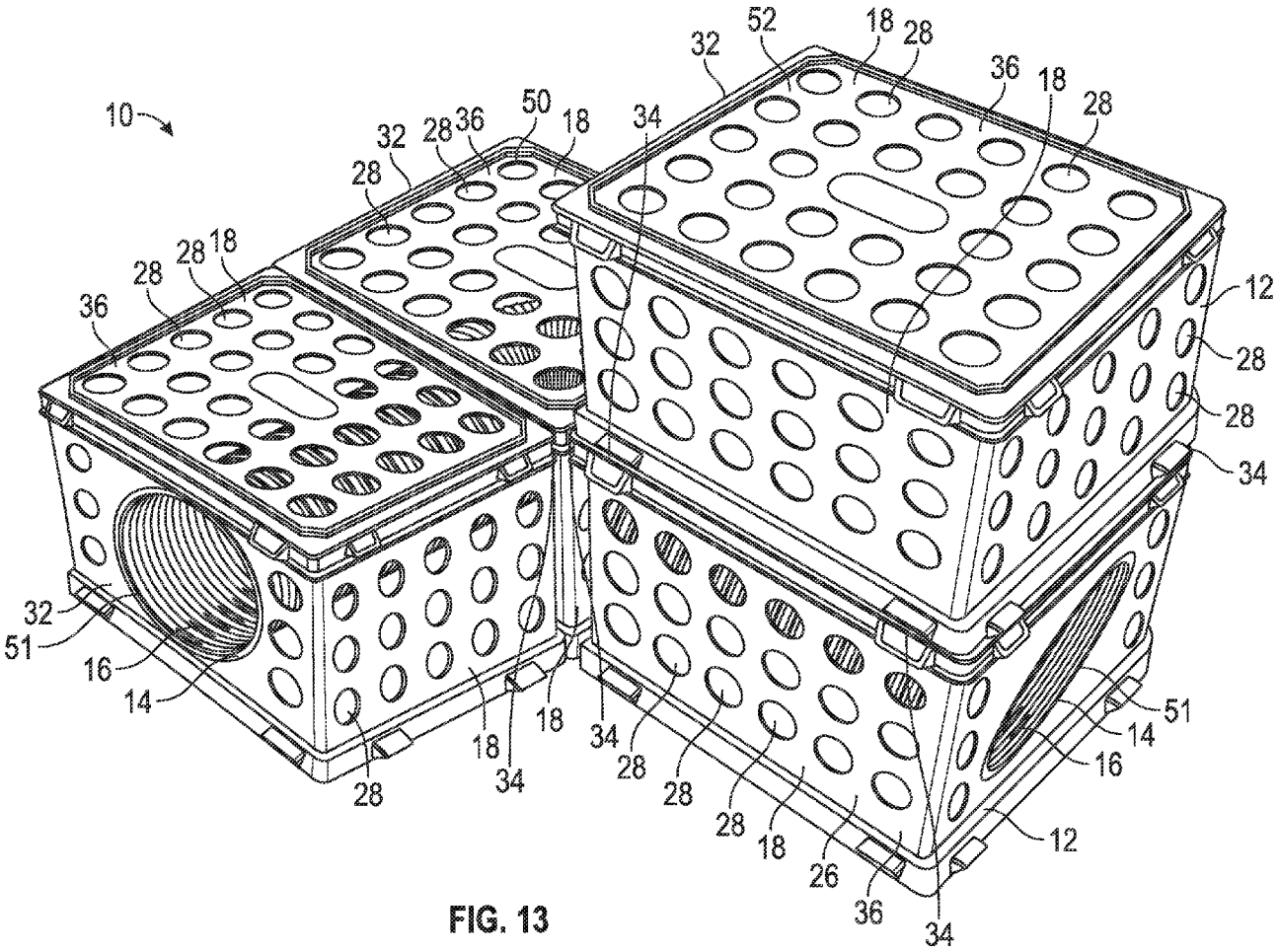
FIG. 13 is an isometric view of an aggregate replacement configured according to a seventh embodiment.

FIG. 13 illustrates another embodiment of an aggregate replacement 10. In this figure, the aggregate replacement 10 is formed from multiple units 36. Each unit 36 is formed from four faces 18. Each face 18 is illustrated as a flat rectangular member as described previously. Each face 18, however, may also be curved or angled. The face 18 may also be formed as a rectangle, square, oval, circle or the like. Each face 18 may be formed in any shape or size desired.

Each face 18 also has at least one opening 28 formed in it. Typically, multiple openings 28 will be formed in the face 18. Each opening 28 passes completely through the face 18 in order to allow fluid, such as water, to travel through the face 18 to the interior of the aggregate replacement 10. In alternate embodiments, the fluid may travel through the face 18 to the exterior of the aggregate replacement 10.

The openings 28 are illustrated as circles, however, they may be circles, squares, triangles, rectangles, hexagons, pentagons, polygons and the like. The openings 28 may be formed in any shape desired that allows fluid to easily pass through the face 18 while leaving the face 18 strong enough to withstand the weight and stresses of use.

In FIG. 13, the aggregate replacement 10 units 36 are formed using four faces 18 coupled together at right angles. In alternate embodiments, however, multiple faces 18 may be used. The angle that each face 18 is coupled to the next face 18 depends on the number of faces 18 being used.

Each face 18 is additionally coupled to a proximal end 12 and a distal end 32 in order to form a structure 26. The faces 18 and the proximal end 12 and distal end 32 may be identical or similar and may be interchangeable in certain embodiments.

The proximal end 12 and the distal end 32 are illustrated as square or rectangular members. The shape of the proximal end 12 and the distal end 32, however, will depend on the number of faces 18 used in order to form the structure 26. The proximal end 12 and the distal end 32 may be any size or shape desired. The proximal end 12 and the distal end 32 should, however, provide a cover or substantially close the open ends of the structure 26 formed by the faces 18.

The proximal end 12 and the distal end 32 of each unit 36 may be similar to the at least one face 18 discussed above. The proximal end 12 and distal end 32 may each have at least one opening 28 in its surface in order to allow fluid to easily pass to through the surface of the aggregate replacement 10. The fluid may pass to the inside of the aggregate replacement 10 or to the outside, depending on the desired use of the aggregate replacement 10.

Certain configurations of aggregate replacement 10 units 36 may simply replace large portions of aggregate. These units 36 may be referred to as pipe-less units 52. Pipe-less units 52, as illustrated, have multiple openings 28 on all surfaces. They do not, however, have an opening that would retain or replace a pipe such as a pipe used in a typical drainage field.

Pipe-less units 52 may be any size or shape desired.

Pipe-less units 52 may be coupled to units 36 containing pipe, in order to replace larger areas of aggregate. Multiple pipe-less units 52 may be coupled to units 36 with pipe in order to create large drain fields.

If desired, pipe-less units 52 may also be used in areas where it is desired to drain fluid, but not divert it. Diverting fluid from a given area typically requires some sort of pipe or conduit to direct the fluid. However, if the user simply wants to help a field or yard drain better, pipe-less units 52 may be placed under the surface of the soil in order to give the fluid an area to drain to.

Multiple pipe-less units 52 may also be coupled together.

In alternate embodiments, pipe-less units 52 may be formed from multiple panels, faces or ends which may be coupled together to form the desired shape and size. The multiple panels, faces or ends could also be cut to the desired size in order to allow a user to create custom size pipe-less units 52 for their various applications. Similar configurations could be used for units 36 containing pipe.

As illustrated in FIG. 13, other units 36 may contain a pipe 14. These units 36 are similar to those discussed above with respect to previous figures, except that in the units 36 illustrated in this figure, the pipes 14 are formed as an integral part of the aggregate replacement 10 units 36. The pipes 14 may also be coupled to the aggregate replacement 10 units 36 or may simply be placed in the aggregate replacement 10 units 36, rather than formed as an integral part of the aggregate replacement 10 units 36.

The pipes 14 used in the aggregate replacement 10 will typically be a plastic pipe with perforations 16 formed in it. These perforations 16 allow fluid from the outside of the pipe 14 to seep into the pipe 14. The perforations 16 may be circular holes, linear cuts or the like formed in the pipe 14. The pipe 14 then diverts the fluid such as water to a more desirable location.

In alternate uses, such as septic drainage fields, the perforations 16 in the pipe 14 may allow the fluid inside the pipe 14 to seep out.

The pipe 14 may or may not be corrugated. The pipe 14 may be any size, shape or length desired. The pipe 14 may have a circular, square, rectangular or triangular cross-section or the like. The pipe 14 may be rigid or flexible plastic. The pipe 14 may also be formed from any material desired, such as plastic, fiberglass, iron, copper, steel, aluminum or the like.

The pipes 14 are in communication or coupled to a pipe opening 51 formed in the proximal end 12 and the distal end 32 of each unit 36. The pipe opening 51 is an opening in the proximal end 12 and the distal end 32 of the units 36 that is approximately the same size as the pipe 14 and which secures the pipe 14 in place, Additional embodiments of aggregate replacement 10 units 36 may include units that act as 90 degree turns, T's, 45 degree turns, and discharges. A 90 degree turn unit 50 is illustrated in the figure. The 90 degree turn unit 50 has a pipe opening 51 in the proximal end 12 of the unit. It also has a pipe opening 51 in one of the faces 18 of the unit 50. This causes the pipe 14 in the 90 degree turn unit 50 to turn 90 degrees within the aggregate replacement 10. This type of unit 50 may be useful in draining water from around concrete foundations and the like.

A T unit 36 in the aggregate replacement 10 would include a pipe opening 51 in the proximal end 12 of the unit 36. Additional pipe openings 51 would be located in two parallel faces 18 located opposite each other in the unit 36. The pipe 14 would start at the proximal end 12 of the aggregate replacement unit 36. The pipe 14 would then split into two pipes 14 with one pipe 14 coupled to each of the pipe openings 51 formed in the faces 18 of the unit 36. In use, fluid would either flow into the unit 36 as one stream and leave the unit 36 as two, or else two streams of fluid would be combined into one stream as it leaves the unit 36.

Other pipe 14 configurations or fittings could be formed in the aggregate replacement 10 units 36 similarly to those described above.

Multiple aggregate replacement 10 units 36 may be coupled together using connectors 34. Connectors 34 may be any type of coupling device or method that allows multiple units 36 to be hooked together. This may include units 36 being coupled with male and female connectors or units being coupled with connectors 34 such as those described in conjunction with FIG. 11. Connectors 34 may be permanent or removable. Removable connectors 34 may be desirable in order to allow damaged aggregate replacement 10 units 36 to be removed and replaced.

Units 36 may be coupled together end to end, such as where the proximal end 12 of one unit 36 is coupled to the distal end 32 of another unit 36, or the units 36 may be coupled or connected side to side or stacked.

In embodiments where a pipe 14 is formed as an integral part of the aggregate replacement 10, it may be desirable to couple the separate pipe 14 sections together as well as the units 36.

Figure 14:
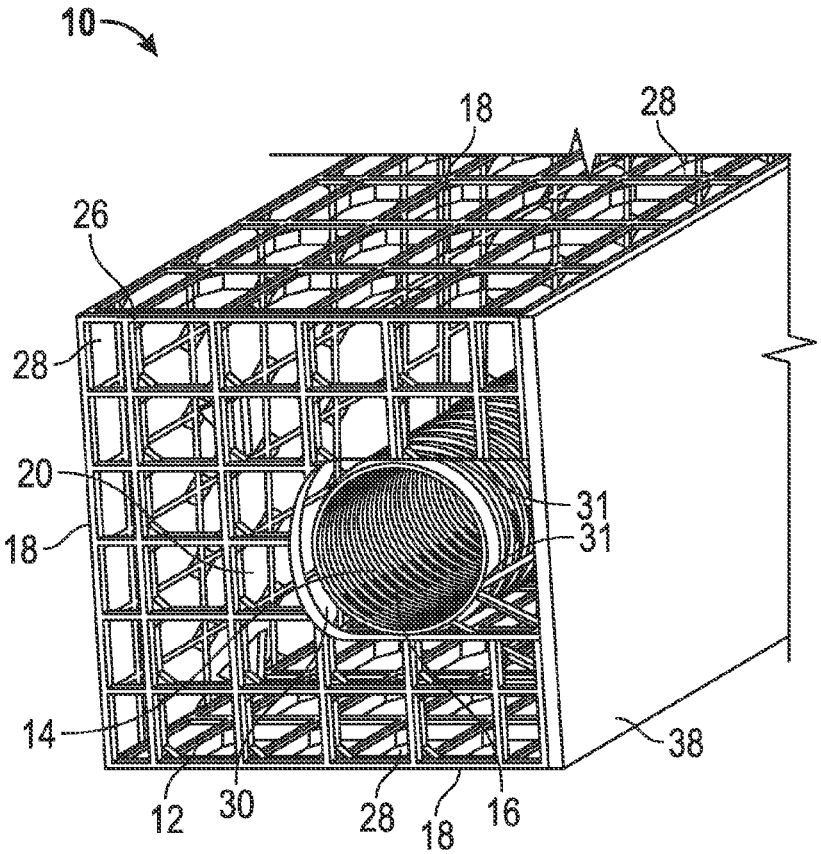
FIG. 14 is an isometric view of an aggregate replacement configured according to an eighth embodiment.

FIG. 14 illustrates an alternate embodiment of FIG. 9. In FIG. 14 the strap 38 covers the entire mouth of the pipe retainer 31. The strap 38 may also cover the entire face 18 of the aggregate replacement 10 in which the mouth of the pipe retainer 31 is located. The strap 38 may be any size, shape, thickness or formed from any material desired. The strap 38 may be corrugated or flat. The strap 38 may also be bent, curved, angled or the like. The strap 38 may be formed from rigid or flexible material.

Figure 15:
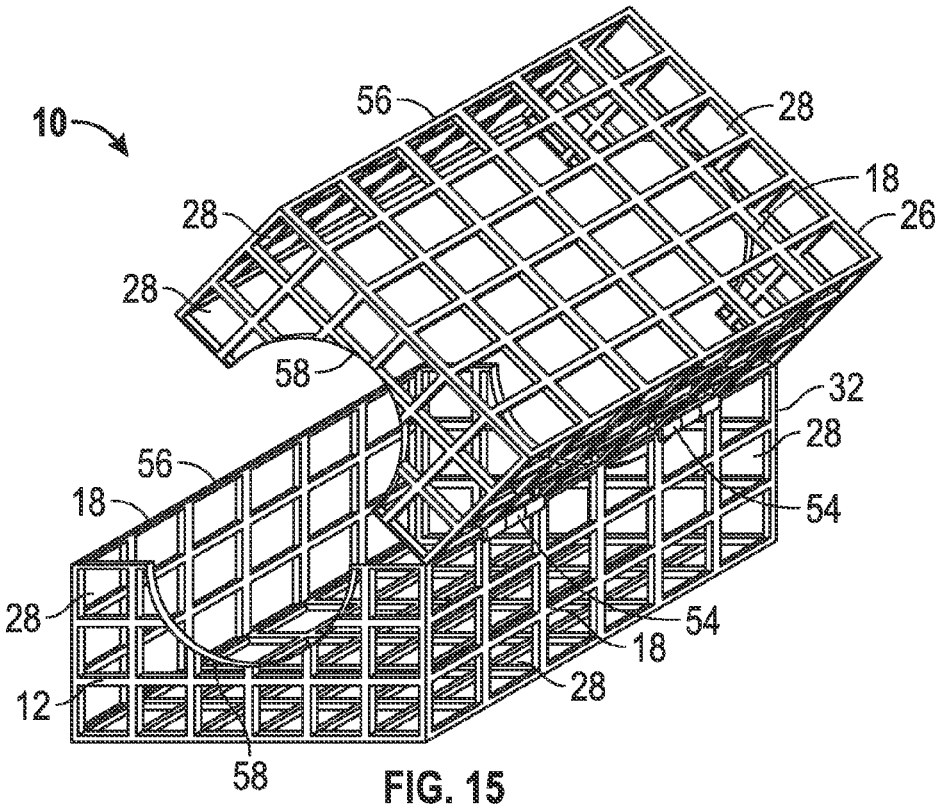
FIG. 15 is an isometric view of an aggregate replacement configured according to a ninth embodiment.

FIG. 15 illustrates an additional embodiment of an aggregate replacement 10. In this embodiment, the aggregate replacement 10 is formed in two sections 56. Each section 56 has three faces 18 and a proximal end 12 and a distal 32 end. The proximal end 12 and distal end 32 of the aggregate replacement 10 include or comprise a cutout 58. The cutout 58, as shown in the figures, is a half circle opening along the edge of the proximal end 12 and distal end 32 configured to receive a pipe. The cutout 58 may also be any shape desired. The cutout 58 may be horseshoe shaped, square, rectangular, triangular or the like, provided the cutout 58 can accommodate or receive a pipe.

The two sections 56 of the aggregate replacement 10 are coupled together on one side by at least one hinge 54 or other rotatable coupler. Hinge 54 may be anything that rotatable couples the two sections 56 together on one side. Examples of hinges 54 may include hinges, flexible members, tethers, and the like. The other side of the two sections 56 are not connected. Two hinges 54 are illustrated in the figure, however, depending on the size of the aggregate replacement 10, more or fewer hinges 54 may be required.

In order to use the embodiment illustrated in FIG. 15, the two sections 56 are rotated into an open position. A pipe is then placed in the cutout 58 of the lower section 56 of the aggregate replacement 10. Once the pipe is in place, the top section 56 of the aggregate replacement 10 is rotatably lowered into a closed position.

In alternate variations on this embodiment, a latch may be used to keep the two sections 56 of aggregate replacement 10 in a closed position.

Additional embodiments may have multiple sections 56 rather than just two. Latches and hinges 58 could be used to secure the multiple sections 56 together.

Figure 16:
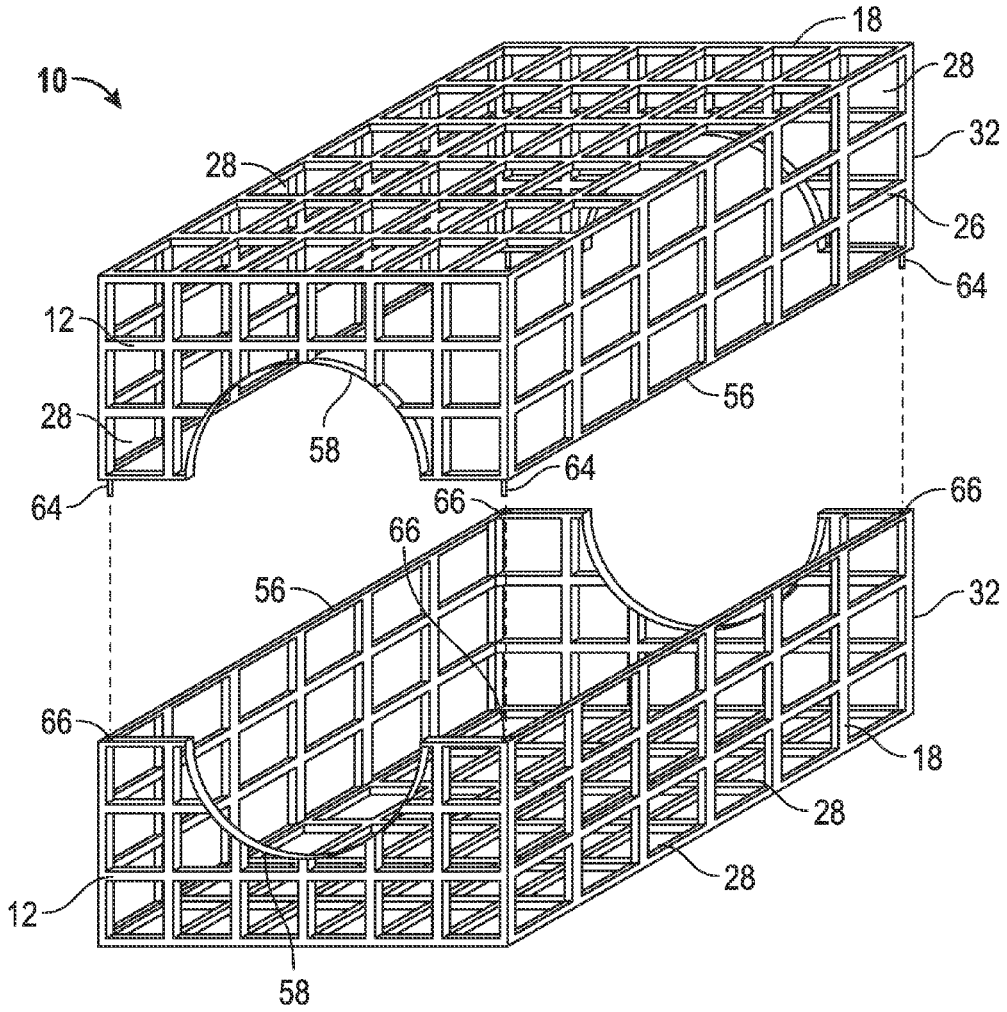
FIG. 16 is an isometric view of an aggregate replacement configured according to a tenth embodiment.

FIG. 16 illustrates an embodiment of an aggregate replacement 10 where the two sections 56 are completely separate. Once the pipe 14 is placed in position in the cutout 58 in the lower section 56 of the aggregate replacement 10, the upper section 56 of the aggregate replacement 10 is put in place.

The upper section 56 of the aggregate replacement 10 may have pins 64 which are inserted into receivers 66 on the lower section 56 of the aggregate replacement 10 in order to secure or couple the two sections 56 together. The pins 64 slide into receivers 66. The pins 64 are simply cylindrical extensions from the structure 26 of the aggregate replacement 10. The receivers 66 are open cylindrical indentations into the structure 26 of the aggregate replacement 10. The pins 64 and the receivers 66 are close enough in size that by inserting the pin 64 into the receiver 66, the sections 56 are kept reasonably securely connected.

Other coupling or connecting configurations may also be used to secure the two sections 56 together. Other connectors may include glue, epoxy, screws, bolts, tabs, latches or the like.

Figure 17:
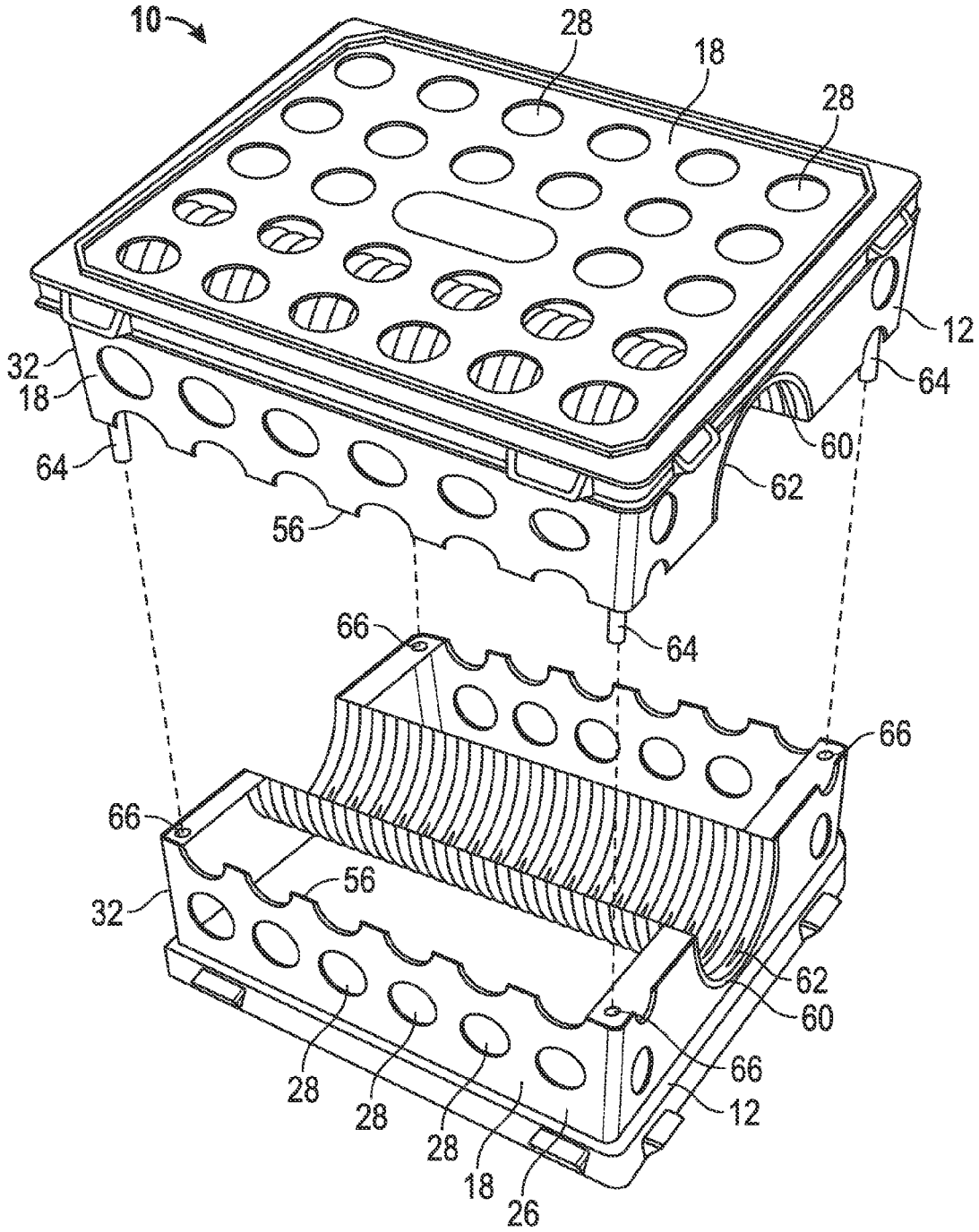
FIG. 17 is an isometric view of an aggregate replacement configured according to an eleventh embodiment.

FIG. 17 illustrates an embodiment of an aggregate replacement 10 which has two sections 56 with half pipes 60 formed integrally in each of the sections 56. The half pipe 60 may alternatively be coupled to each of the sections 56. Each half pipe 60 also has perforations 62 in order to allow fluid to move in and out of the pipe 60. The two sections 56 of the aggregate replacement 10 are snapped together using pins 64 and receivers 66 as described in the previous figure. The pins 64 slide into receivers 66. The pins 64 are cylindrical extensions from the structure 26 of the aggregate replacement 10. The receivers 66 are cylindrical openings in the structure 26 of the aggregate replacement 10. The pins 64 and the receivers 66 are close enough in size that by inserting the pin 64 into the receiver 66, the two sections 56 of the aggregate replacement 10 are kept reasonably securely connected.

The two sections 56 may also be coupled together using bolts, screws, glue, epoxy, latches and the like.

When the two sections 56 are coupled together, the two half pipes 60 meet and form a channel or pipe through which water or other fluid may flow.

In alternate configurations of this embodiment, the two half pipes 60 may have connectors, couplers or latches which secure the two half pipes 60 together.

Figure 18:
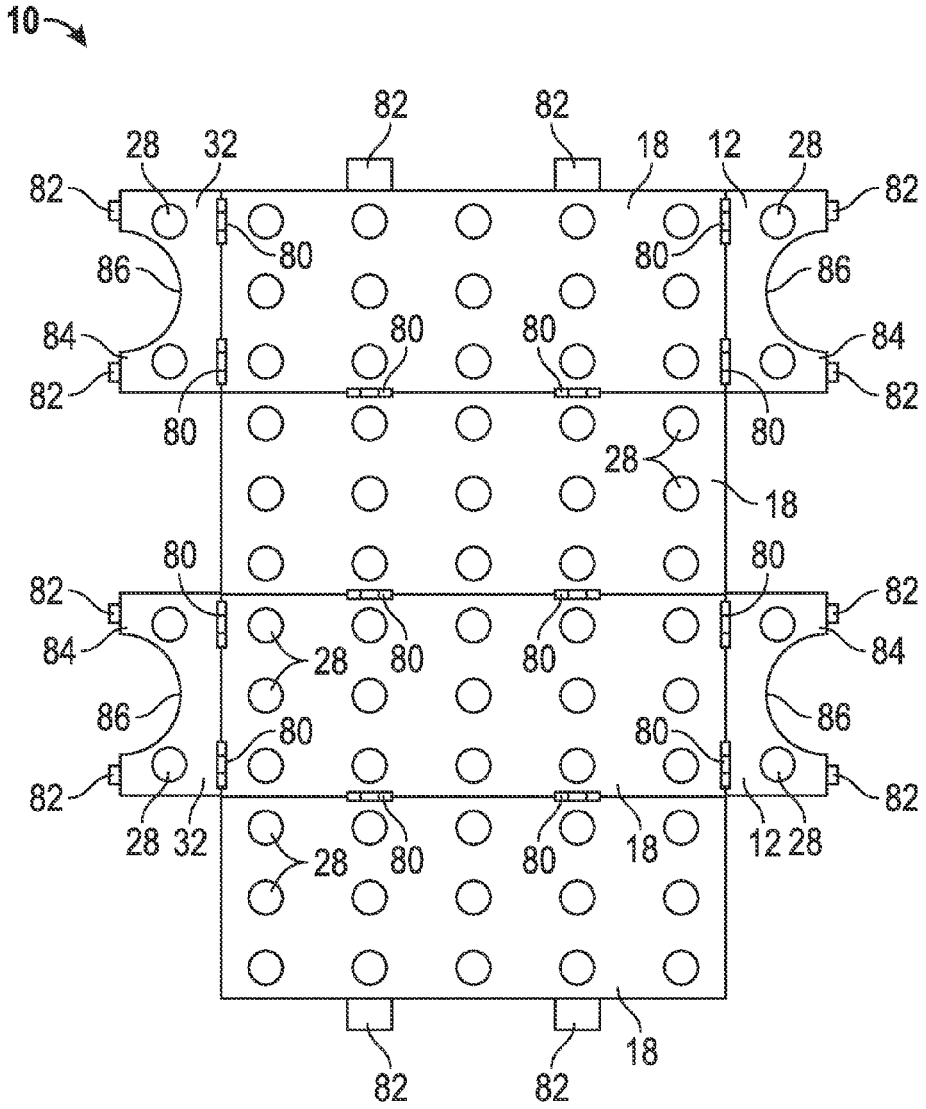
FIG. 18 is a top view of an aggregate replacement configured according to a twelfth embodiment.

FIG. 18 illustrates a collapsible embodiment of an aggregate replacement 10. In this configuration, each face 18 of the aggregate replacement 10 is hingedly coupled to at least one other face 18 of the aggregate replacement 10.

The two faces 18 on the ends have connectors 82 coupled to their outside edges. These connectors 82 act to hook the two outside faces 18 together in order to form a rectangular prism from all of the faces 18.

In alternate embodiments, one face 18 may be bent and coupled together in order to form a cylindrical aggregate replacement 10. Three faces 18 may be coupled together to form a triangular prism. Different numbers of faces 18 may be used in order to form different shapes of aggregate replacement 10.

Two of the faces 18 are also hingedly coupled to a partial proximal end or distal end 84. The partial ends 84 may be formed as a square with a half circle cutout 86 formed in the edge. The partial ends 84 may also be formed in any other shape desired. The shape of the partial ends 84 will likely depend on the shape created by the faces 18 when they are coupled together.

The partial ends 84 may have at least one connector 82 coupled to at least one of their edges. The at least one connector 82 may serve to secure the partial ends 84 in place when the aggregate replacement 10 is fully assembled.

In order to assemble the collapsible aggregate replacement 10 illustrated, the faces 18 may be coupled together in a rectangular prism using the connectors 82 attached to the two end faces 18. A pipe may then be inserted into the aggregate replacement 10. The partial ends 84 are then rotated and secured into place using the connectors 82 coupled to them.

The partial ends 84 secure the pipe in place in the aggregate replacement 10.

The collapsible aggregate replacement 10 may also be assembled by placing the pipe across at least one face 18 of the aggregate replacement 10. The aggregate replacement 10 is then assembled around the pipe.

Figure 19:
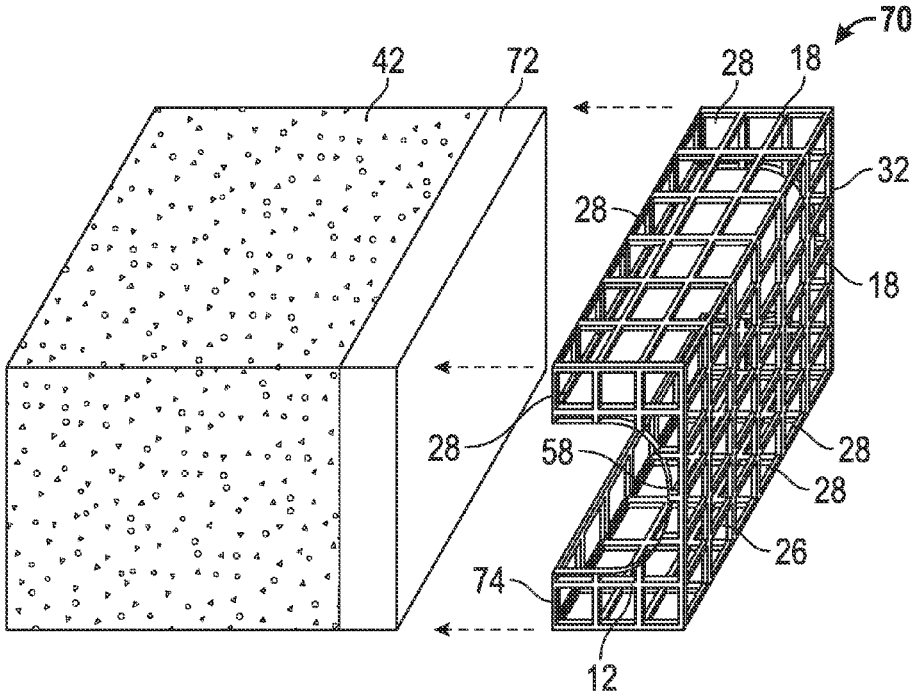
FIG. 19 is an isometric view of an aggregate replacement concrete form configured according to a second embodiment.

FIG. 19 illustrates a configuration of an aggregate replacement 70 for use with a concrete form. In this configuration, a permanent concrete form 72 such as a form that acts as a drain is put in place. The aggregate replacement 70 is then placed adjacent the concrete form 72. The aggregate replacement 70 acts to replace the aggregate, such as loose gravel, which is placed around permanent concrete forms 72 in order to help the concrete form 72 to drain any water near the concrete 42.

The aggregate replacement 70 in this configuration also has a cutout 58 which intersects the edge of the proximal end 12 and the distal end 32 and which would allow a pipe to be placed next to the permanent concrete form 72 in order to aid with the drainage of water. The cutout 58 or open area may run the entire length of the aggregate replacement 70 along the area where the pipe would be placed, so that the pipe abuts the concrete form 72 directly.

In alternate embodiments, water permeable material may be placed between the aggregate replacement 70 and the concrete form 72. In these configurations, the pipe would abut the water permeable material which would abut the concrete form 72.

In other embodiments, a small section of aggregate replacement 70 may separate the pipe from the concrete form 72 or water permeable material.

Additional embodiments, may not include cutouts 58 for pipe.

Figure 20:
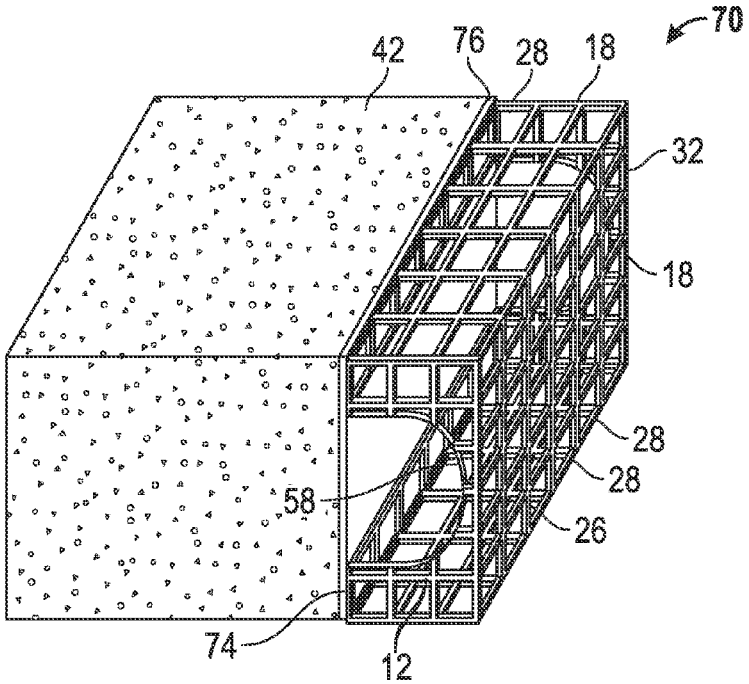
FIG. 20 is an isometric view of an aggregate replacement concrete form configured according to a third embodiment.

FIG. 20 is an additional embodiment of an aggregate replacement 70 for use as a concrete form. In this embodiment, the aggregate replacement 70 is the concrete form. The aggregate replacement 70 is placed into position along the location where the concrete 42 is to be poured. A water permeable material 74 is placed over the surface of the aggregate replacement 70 and then the concrete 42 is poured. The water permeable material 74 prevents the concrete from entering the aggregate replacement 70 while allowing any moisture near the concrete to travel out into the aggregate replacement 70.

The aggregate replacement 70 illustrated in this figure is also configured with a cutout 58 for receiving a pipe. The pipe may be placed before or after the concrete 42 is poured. Typically, however, the pipe will be placed prior to the concrete 42 being poured because it would be too difficult to place the pipe after.

The cutout 58 is formed in the edge of the proximal end 12 and the distal end 32 of the aggregate replacement 70. The cutout 58 also runs along the entire length of the aggregate replacement 70 so that the pipe abuts the water permeable material directly. The pipe acts to collect moisture around the concrete. The pipe then channels the moisture away from the concrete.

In alternate embodiments, a small section of aggregate replacement 70 may separate the pipe from the water permeable material.

Additional embodiments may not include cutouts 58 for a pipe.

In configurations where the aggregate replacement 70 is used as a concrete form or with a concrete form, it may be necessary to secure the aggregate replacement 70 in position by driving a wooden or metal stake through the aggregate replacement 70 and into the ground.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The embodiments and examples set forth herein were presented in order to best explain the present invention and its practical applications and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

The invention claimed is:

1. An aggregate replacement device comprising:

at least one first section;

at least one second section configured to couple to said at least one first section and further comprising a proximal end, a distal end, and at least one face wherein said at least one face further comprises a plurality of first openings;

wherein said at least one first section is configured to couple to said at least one second section transverse to said proximal end and said distal end;

wherein said at least one first section and at least one second section are hingedly coupled;

a second opening in said proximal end of said at least one second section;

a third opening in said distal end of said at least one second section;

wherein said second opening and said third opening are configured to receive a pipe; and wherein said pipe, when received in said second opening, extends through said at least one second section and said pipe is also received in said third opening.

2. The aggregate replacement device of claim 1, wherein said at least one first section further comprising a proximal end, a distal end, and at least one face wherein said at least one face further comprises a plurality of first openings.

3. The aggregate replacement device of claim 1, further comprising at least one connector for connecting at least two of said aggregate replacement devices together.

4. The aggregate replacement device of claim 1, wherein said at least one second section further comprising said at least one face is transverse to said proximal end and to said distal end.

5. An aggregate replacement device comprising:

a structure comprising two sections and wherein each of said two sections comprises a proximal end, a distal end, and three faces wherein said three faces further comprise a plurality of first openings;

at least one cutout in said proximal end of each of said two sections;

wherein said at least one cutout intersects an edge of said proximal end;

wherein said at least one cutout in said proximal end of each of said two sections align to form an opening for receiving a pipe when said two sections are coupled together; and wherein said two sections further comprise said distal end having at least one cutout and a half pipe being in communication with said at least one cutout in said proximal end and said at least one cutout in said distal end.

6. The aggregate replacement device of claim 5, further comprising at least one cutout in said distal end of each of said two sections and wherein said at least one cutout intersects an edge of said distal end.

7. The aggregate replacement device of claim 5, further comprising placing a pipe in said at least one cutout and coupling a first of said two sections to a second of said two sections.

8. The aggregate replacement device of claim 5, further comprising said two structures hingedly coupled.

9. The aggregate replacement device of claim 5, further comprising said two-sections coupled together with at least one coupler.

10. The aggregate replacement device of claim 5, wherein said two sections are coupled together so that said half pipes form a whole pipe.

11. The aggregate replacement device of claim 5, wherein said aggregate replacement device abuts a permanent concrete form.

12. The aggregate replacement device of claim 11, further comprising a second at least one cutout in said distal end of each of said two sections wherein said at least one cutout in said proximal end of each of said two sections and said second at least one cutout in said distal end of each of said two sections are configured to receive a pipe.

13. The aggregate replacement device of claim 5, wherein said aggregate replacement device is used as a concrete form.

14. An aggregate replacement device comprising:

a first section and a second section configured to couple together;

wherein said first section comprises three faces coupled transversely to each other;

said first section further comprising a proximal end and a distal end coupled transversely to said three faces;

wherein said three faces, said proximal end and said distal end further comprise a plurality of openings;

said distal end and said proximal end further comprising a cutout, wherein said cutout intersects an edge of said distal end and said proximal end;

wherein said cutout is configured to receive a pipe;

said second section comprising at least one face comprising a plurality of openings;

said first section is coupled to said second section with said at least one face of said second section parallel to one of said three faces of said first section; and wherein said first section and said second section are hingedly coupled together.

15. The aggregate replacement device of claim 14, further comprising at least one coupler for coupling said first section to said second section.

16. The aggregate replacement device of claim 14, wherein said pipe is received in said cutout in said proximal end of said first section and said cutout in said distal end of said first section and passes through the interior of said first section.

17. The aggregate replacement device of claim 16, wherein when said first section is coupled to said second section, an interior of said aggregate replacement device is empty except for said pipe.

* * * * *

UNITED STATES PATENT AND TRADEMARK OFFICE

CERTIFICATE OF CORRECTION

PATENT NO. : 9,206,574 B2
APPLICATION NO. : 14/282801
DATED : December 8, 2015
INVENTOR(S) : Parker It is certified that error appears in the above-identified patent and that said Letters Patent is hereby corrected as shown below:

On the title page item [57], delete "take".

Signed and Sealed this
Twelfth Day of July, 2016

Michelle K. Lee

Michelle K. Lee
*Director of the United States Patent and Trademark Office*